US006474348B1

(12) United States Patent
Beggs et al.

(10) Patent No.: US 6,474,348 B1
(45) Date of Patent: Nov. 5, 2002

(54) CNC CORE REMOVAL FROM CASTING PASSAGES

(75) Inventors: James L. Beggs, Hart, MI (US); Paul C. Jensen, Muskegon, MI (US)

(73) Assignees: Howmet Research Corporation, Whitehall, MI (US); Controlco Inc., Muskegon, MI (US)

( * ) Notice: Subject to any disclaimer, the term of this patent is extended or adjusted under 35 U.S.C. 154(b) by 0 days.

(21) Appl. No.: 09/409,833

(22) Filed: Sep. 30, 1999

(51) Int. Cl.[7] ..... B22D 29/00

(52) U.S. Cl. ..... 134/22.12; 134/22.1; 134/22.11; 134/22.18; 134/23; 134/24; 164/454

(58) Field of Search ..... 134/22.1, 22.11, 134/22.12, 23, 24, 22.18; 264/219; 164/454

(56) References Cited

U.S. PATENT DOCUMENTS

| | | | | |
|---|---|---|---|---|
| 1,304,200 A | | 5/1919 | Prescott | |
| 1,814,928 A | | 7/1931 | Hourigan | |
| 2,086,653 A | | 7/1937 | Watson et al. | |
| 3,486,938 A | | 12/1969 | Dubitsky | 134/2 |
| 3,643,728 A | | 2/1972 | Hulse | 164/132 |
| 3,799,178 A | | 3/1974 | Anderson et al. | 134/58 |
| 4,350,174 A | | 9/1982 | Bolten et al. | 134/104 |
| 4,438,804 A | | 3/1984 | Aiga et al. | 164/522 |
| 4,439,241 A | | 3/1984 | Ault et al. | 134/22.17 |
| 5,143,665 A | | 9/1992 | Clubbs et al. | 264/221 |
| 5,167,721 A | * | 12/1992 | McComas et al. | 134/32 |
| 5,182,849 A | | 2/1993 | Marco | 29/600 |
| 5,242,007 A | | 9/1993 | Remmers et al. | 164/4.1 |
| 5,273,104 A | | 12/1993 | Renaud et al. | 164/529 |
| 5,332,023 A | * | 7/1994 | Mills | 164/132 |
| 5,522,447 A | | 6/1996 | Sandstrom et al. | 164/28 |
| 5,679,174 A | * | 10/1997 | Buongiorno | 134/22.18 |
| 5,778,963 A | | 7/1998 | Parille et al. | 164/132 |
| 5,803,151 A | | 9/1998 | Carden | 164/5 |
| 5,814,161 A | * | 9/1998 | Sachs et al. | 134/21 |
| 5,913,354 A | | 6/1999 | Conroy et al. | 164/131 |
| 5,915,452 A | | 6/1999 | Conroy et al. | 164/345 |
| 6,177,038 B1 | * | 1/2001 | Reed et al. | 264/157 |

FOREIGN PATENT DOCUMENTS

| | | | | |
|---|---|---|---|---|
| DE | 35 37 351 A1 | | 4/1987 | |
| GB | 2275341 A | * | 8/1994 | G01M/19/00 |
| RU | 470365 | | 1/1974 | |
| RU | 643232 A | * | 1/1979 | B22D/29/00 |
| RU | 923718 | | 6/1980 | |
| RU | 1220222 A1 | * | 8/1995 | B22D/29/00 |

* cited by examiner

*Primary Examiner*—Randy Gulakowski
*Assistant Examiner*—Jiri Smetana

(57) ABSTRACT

A method of removing ceramic core material from an internal passage of a superalloy airfoil casting using a CNC controlled fluid spray nozzle in a manner that the fluid spray nozzle is caused to laterally scan and/or rotary orbit an area of one or more openings of one or more passages at an exterior casting surface to improve removal of material residing in the passage.

4 Claims, 5 Drawing Sheets

CNC CORE REMOVAL FROM CASTING PASSAGES

FIELD OF THE INVENTION

The present invention relates to a method of flowing pressurized fluid into one or more internal passages of a casting to remove ceramic cote or other material.

BACKGROUND OF THE INVENTION

In the investment casting of nickel or cobalt based superalloy turbine airfoils (e.g. turbine blades and vanes), a ceramic core is positioned in the investment shell mold to produce cooling air passages internal of the casting when the molten superalloy is cast and solidified in the mold about the core.

Following casting, the ceramic core must be removed from the casting to leave the internal air cooling passages therein. In the past, the ceramic core has been removed from the cast turbine airfoil by an autoclave technique, open kettle technique or other technique. One autoclave technique involves immersing the casting in an aqueous caustic solution (e.g. 45% KOH) at elevated pressure and elevated temperature (e.g. 250 psi and 177 degrees C) for an appropriate time to dissolve or leach the core from the casting. U.S. Pat. Nos. 4,134,777 and 4,141,781 disclose autoclave techniques to remove a ceramic core.

An exemplary open kettle technique involves immersing the casting in a similar aqueous caustic solution at ambient pressure and elevated temperature (e.g. 132 degrees C) with agitation of the solution for a time to dissolve or leach the core from the casting.

U.S. Pat. No. 5,915,452 discloses removing a ceramic core from a casting using a caustic fluid at elevated temperature sprayed under pressure at an exposed region of the core in the casting.

U.S. Pat. No. 5,778,963 describes core removal using a caustic solution sprayed at a pressure of 5000 to 10,000 psi at the core in the casting. The patent indicates that ceramic core residue can be removed by directing a stream of water or steam at the casting following the high pressure spraying treatment.

U.S. Pat. No. 4,439,241 describes a caustic autoclave treatment to soften engine run deposits in internal airfoil passages followed by a waterblast treatment where water is sprayed at greater than 2000 psi from a spray nozzle through the passages to remove any remaining softened deposits from the internal passages.

An object of the present invention is to provide an improved method for removing material from an internal passage of a metallic body such as, for example, internal passages of a casting.

SUMMARY OF THE INVENTION

The present invention provides in one embodiment a method of flowing a fluid into an internal passage of a body, such as a metallic casting, to remove ceramic core material or other material therefrom under CNC control of a fluid spray nozzle in a manner that the fluid spray nozzle is caused to laterally scan a two dimensional area of each opening of one or more passages at an exterior casting surface to improve removal of ceramic core or other material residing in the passage. In an illustrative embodiment of the invention, an area of each opening of an internal passage at an exterior casting surface is scanned laterally in X and Y orthogonal directions with a fluid spray nozzle under CNC control. Motion of the fluid spray nozzle in a Z axis orthogonal to the X and Y axes also is CNC controlled to provide optimum positioning of the spray nozzle relative to the passage opening.

The present invention provides in another embodiment a method of flowing a fluid into an internal passage of a casting to remove ceramic core material or other material therefrom under CNC control of a fluid spray nozzle in a manner that the fluid spray nozzle is caused to orbitally scan a two dimensional area of each opening of one or more passages at an exterior casting surface.

Openings at the root end, tip end or trailing edge of a gas turbine engine airfoil superalloy casting (e.g. turbine blade or vane) can be scanned under CNC control pursuant to embodiments of the invention to remove residual ceramic core material from internal cooling passages.

The objects and advantages of the present invention will become more readily apparent from the following description taken with the following drawings.

DETAILED DESCRIPTION OF THE INVENTION

Figure 1:
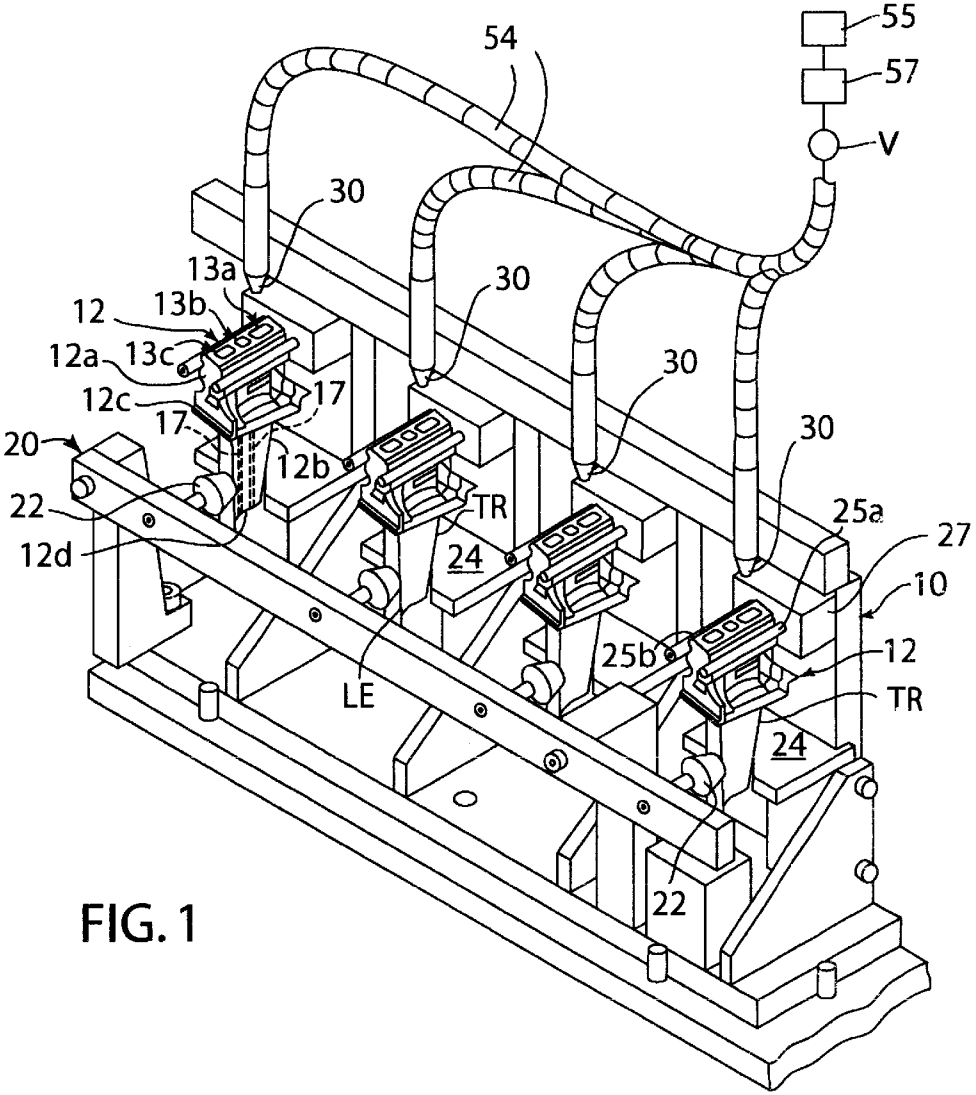
FIG. 1 is a perspective view of apparatus for practicing an embodiment of the invention.
Figure 1A:
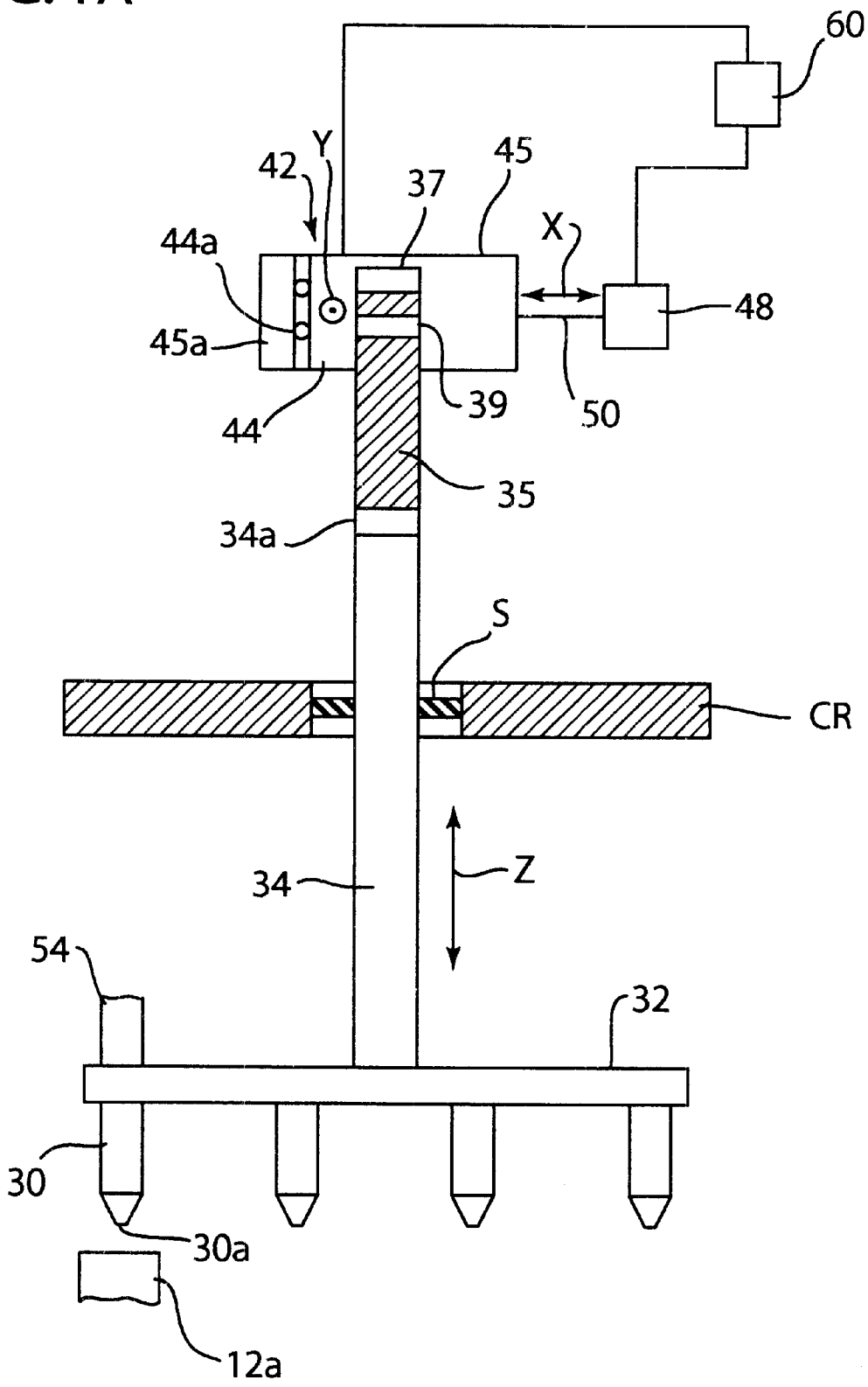
FIG. 1A is a schematic view of the fluid spray nozzles mounted on a plate connected to a slide mechanism to impart scanning motion to the fluid spray nozzles.

Referring to FIGS. 1 and 1A, apparatus for practicing an embodiment of the invention is illustrated as comprising a fixture 10 for holding one or more gas turbine engine blade superalloy castings 12 in a root up orientation. In particular, each turbine blade casting 12 includes a root end 12*a* connected to an airfoil 12*b* by a platform region 12*c*. The airfoil terminates in tip end 12*d*. The root end includes openings 13*a*, 13*b*, 13*c* at the exterior surface of the root end 12*a* in FIG. 1, while the tip end 12*d* includes openings 15*a*, 15*b*, 15*c*, 15*d* at the exterior surface of the tip end in FIG. 4. The openings 13*a*–13*c* and 15*a*–15*d* are interconnected by one or more internal passages 17 formed inside the casting 12 by a ceramic core (not shown) which has been partially removed by a prior core removal treatment of the castings 12. The core removal treatment can comprise the aforementioned autoclave, open kettle, caustic pressure spray, and other treatment that partially removes the ceramic core from the castings 12 to leave the internal passages 17, which may have residual ceramic core material therein. For example, in some cases, the residual ceramic core material can comprise ceramic core material whose binder (e.g. silica) has been chemically dissolved or attacked by the prior core removal treatment to weaken or soften remaining ceramic core material and allow removal thereof from the internal passages by the invention. In other cases, there may remain less residue of ceramic core material that still needs to be removed from the internal passages.

The fixture 10 is shown including a clamp assembly 20 that includes conical clamp members 22 and cooperating stops 24 that engage and clamp respective airfoils 12*b* of the respective castings 12, while the root 12*a* is held on pins 25*a*, 25*b* residing in the root fir tree grooves on opposite sides of the root 12*a* and held against root stop 27.

The fixture 10 and fluid spray nozzles 30 are disposed in an enclosure or cabinet (only cabinet ceiling shown in FIG. 1A) so that fluid sprays are confined in the cabinet. The cabinet can be of the type shown in U.S. Pat. No. 5,915,452, the teachings of which are incorporated herein by reference, or any other type of cabinet. Multiple fixtures 10 can be positioned on a rotary table or carousel (not shown) in the cabinet below the nozzles 30 to sequentially flush castings on some fixtures, while other fixtures are being loaded or unloaded outside or in a separate compartment of the cabinet. The invention is not limited to the type of fixture 10 shown and can be practiced using any suitable fixture to hold the castings 12 fixed in position relative to fluid spray nozzles 30.

Fluid spray nozzles 30 are shown schematically in FIG. 1A fixedly mounted on a common support plate 32 above the openings 13*a*, 13*b*, 13*c* in the root end 12*a* of the castings 12, FIG. 1. The plate 32 is connected to a shaft 34 that extends through a ceiling or roof CR of cabinet (not shown) in which the fixture 10 and nozzles 30 are disposed. One or more flexible fluid seals S are provided about the shaft 34 in the ceiling. The shaft 34 is connected to a Y axis slide 44, FIG. 1A, that resides on an X axis slide 45 of a conventional compound slide assembly 42. In particular, the shaft 34 is connected to a coupling 34*a* that is connected to a ball screw 35. The X axis slide 45 is mounted on a fixed base (not shown) for linear slide movement in an X-direction by a conventional slide servomotor 48 on the base and slide ball screw drive 50 connected to the servomotor. The Y slide 44 is mounted on a slideway 44*a* of a shoulder 45*a* of X axis slide 45 perpendicular to the X direction for linear slide movement in a Y-direction (see arrow head symbol) orthogonal to the X axis by a conventional slide servomotor and slide ball screw (not shown) mounted on the slide 45. In this way, the fluid spray nozzles 30 can be moved in the orthogonal X and Y directions as described below. The X and Y axis slide servomotors are controlled by a CNC (computer numerical control) unit 60 to move the nozzles 30 in the X and Y directions. The CNC unit 60 can include teachable software where motions of the fluid spray nozzles 30 and locating or centering coordinates of the root end openings or tip end openings of the castings 12 residing in fixture 10 can be taught to the unit 60 by manually moving the nozzles 30 relative to the fixtured castings.

The ball screw 35 is disposed on the Y slide and is rotated by a rotary servomotor 37 relative to a ball nut 39 fixed on the Y slide. The ball screw 35 is rotated by servomotor 37 relative to ball nut 39 for movement in a Z axis orthogonal to the X and Y axes to position the nozzles 30 at an optimum position relative to the openings 13*a*, 13*b*, 13*c* of the root 12*a* (or openings 15*a* through 15*d* of the tip end 12*d*) to direct the fluid spray into each opening and maximize spray force therein. The servomotor 37 is controlled by the CNC unit 60.

Following a core removal treatment, such as the aforementioned autoclave, open kettle treatment, etc. to partially remove the ceramic core from the castings 12, the castings are rinsed in a water bath or spray and fixtured on fixture 10 and positioned beneath the fluid spray nozzles 30 as shown in FIG. 1. The core removal treatment forms no part of the invention and can be practiced pursuant to any of the above mentioned treatments known to the art. The nozzles 30 are brought to a desired position or spacing opposing the openings 13*a*, 13*b*, 13*c* by servomotor 37. The fluid spray nozzles 30 receive pressurized water via respective high pressure hoses 54 communicated to tri-plex pumps 55 by respective electric motors (not shown). The pumps can provide pressurized filtered tap water at pressures up to 3000 psi to a pressure regulator system 57 communicated to hoses 54 when solenoid valve V is opened. The water can be heated to elevated temperature if desired. Fluids other than water may be used in practice of the invention.

The fluid spray nozzles 30 typically each comprise a Washjet solid stream zero degree spray nozzle available from Spraying Systems Co., North Ave., Wheaton, Ill., although the invention is not limited to any particular type of spray nozzle. An exemplary fluid spray nozzle 30 will have a nozzle orifice diameter of 0.035 inch for certain gas turbine airfoil castings, although other orifice diameters can be used in practicing the invention depending upon the casting configuration to be treated.

After the castings 12 are fixtured on fixture 10 and the nozzles 30 positioned relative to the openings 13*a*, 13*b*, 13*c*, the pumps 55 are turned on, valve V is opened, and water at a pressure typically between 800–1500 psi is discharged from a respective nozzle 30 into each opening 13*a*, 13*b*, 13*c* at the root end 12*a* as now described.

Figure 2:
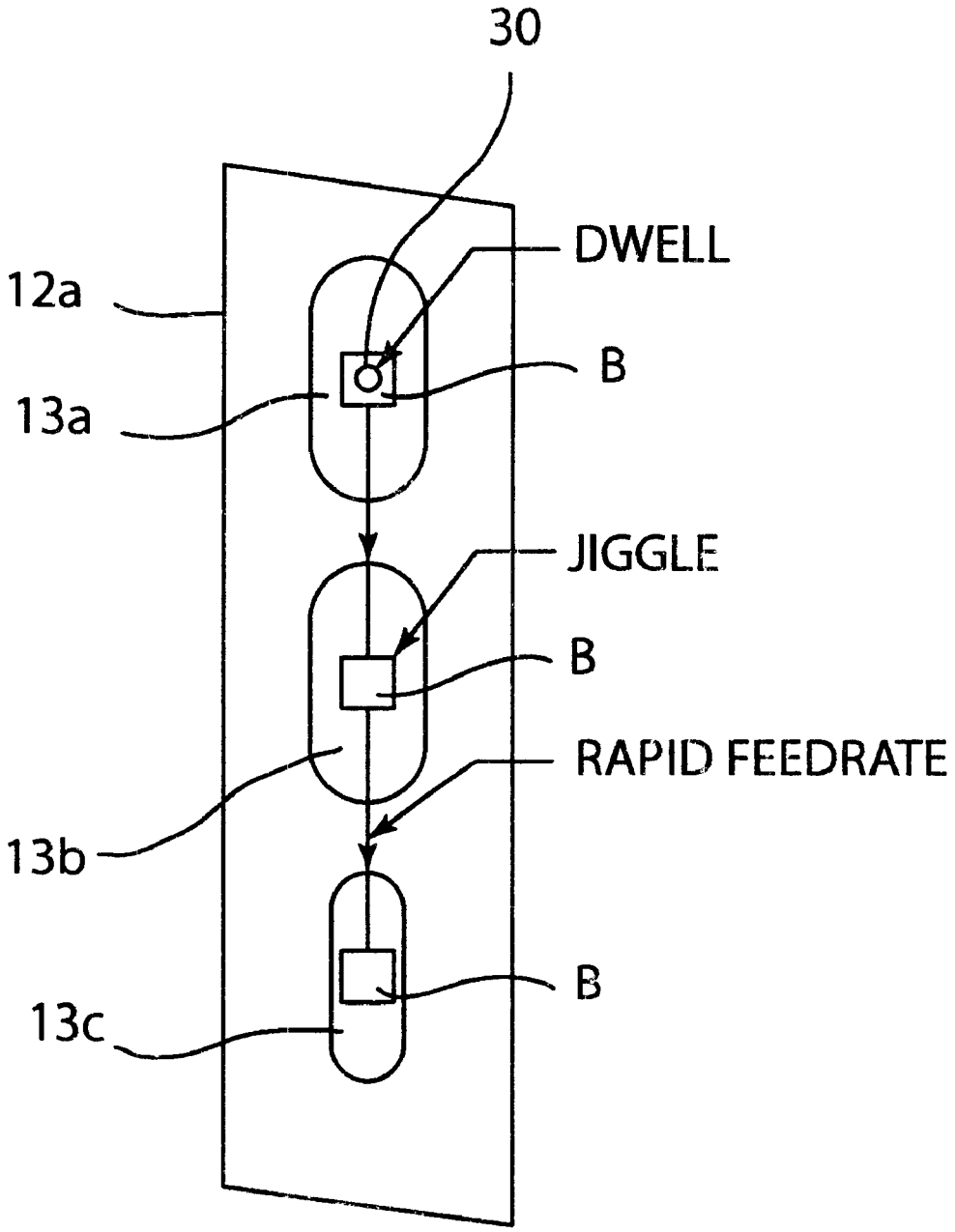
FIG. 2 is a plan view of the end of the root of the airfoil casting showing the pattern of movement of a fluid spray nozzle relative to the root openings.
Figure 3:
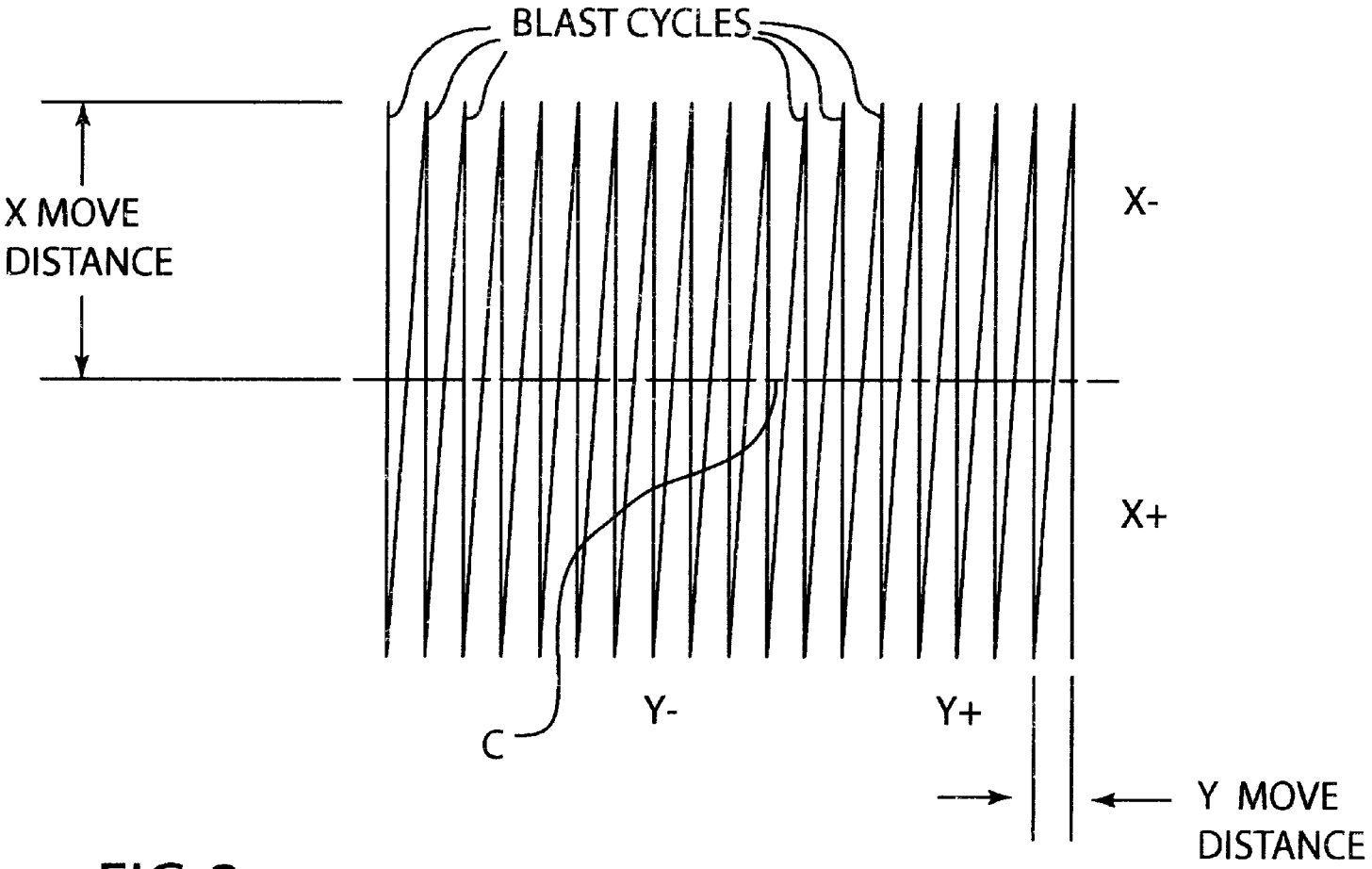
FIG. 3 is a schematic diagram illustrating the lateral scanning motion designated jiggle blast relative to an opening at the root end of the airfoil.

Referring to FIG. 2, the pattern of CNC controlled motion of each nozzle 30 pursuant to an embodiment of the invention is shown relative to a respective root end 12*b*. In particular, each nozzle 30 traverses (as indicated by the arrow heads) successively from opening 13*a* to opening 13*b* to opening 13*c* at each root end 12*a* under CNC control. At each opening, the center of each nozzle 30 initially dwells at a center position C of the opening 13*a*, 13*b*, 13*c* determined by the CNC unit 60 based on previously taught coordinates acquired by the CNC unit and indicated by the circle in FIG. 2 for 10 seconds or other predetermined time. The pressurized water flows through the passages 17 and exits the castings 12 at the other root openings (e.g. 13*b*, 13*c* if opening 13*a* is being water blasted), tip end openings 15*a* through 15*d*, and other openings that may be present on the castings. For example, sometimes, the internal passages 17 include openings along the trailing edge TR of the airfoil 12*b* where the water can exit. Then, at each opening 13*a*, 13*b*, 13*c*, each nozzle is moved under CNC control in a so-called jiggle motion where the center of the nozzle 30 laterally scans a two dimensional area of each opening indicated by the two dimensional box B in FIG. 2 by motions in the X and Y directions as best shown in FIG. 3. In FIG. 3, the X direction of motion of each nozzle 30 is indicated by X− and X+ relative to the center C of the opening 13*a* (or 13*b* or 13*c*), while the Y direction of motion is indicated by Y− and Y+. The aggregate of the X and Y motions causes each nozzle 30 to scan a two dimensional area indicated by the box B in FIG. 2 at each opening 13*a*, 13*b*, 13*c*. Movement of each nozzle 30 in the Y direction is related to movement in the X direction and the number of blast cycles by the equation:

$$Y=(X \text{ move distance/blast cycles}) \text{ multiplied by } 2$$

where X move distance is shown in FIG. 3 and blast cycles are the number of X+ to X− cycles of each nozzle 30. By way of example only, for an X move distance of 0.040 inch and blast cycles of 20, the Y move distance is 0.004 inch.

As illustrated in Table I below, the dimensions of the box B scanned by nozzles 30 and the number of blast cycles can be controlled by the CNC unit 60 and selected from one of the box sizes listed and stored in the CNC unit:

TABLE I

| X move distance | blast cycles |
|---|---|
| .010 inch | 5 |
| .020 | 10 |
| ,030 | 15 |
| .040 | 20 |
| .050 | 30 |

For example, a lateral scan of each nozzle 30 can occur by scanning the X axis at an X move distance of 0.010 inch with 5 blast cycles and Y move distance determined by the above equation. A different scan of each nozzle 30 can occur by scanning the X axis at an X move distance of 0.020 inch with 10 blast cycles and Y move distance determined by the above equation. A still different scan of each nozzle 30 can occur by scanning the X axis at an X move distance of 0.030 inch with 15 blast cycles and Y move distance determined by the above equation. A further scan of each nozzle 30 can occur by scanning the X axis at an X move distance of 0.040 inch with 20 blast cycles and Y move distance determined by the above equation. Another scan of each nozzle 30 can occur by scanning the X axis at an X move distance of 0.050 inch with 30 blast cycles and Y move distance determined by the above equation. One or more of these or other nozzle scans can be carried out at each opening 13*a*, 13*b*, 13*c*.

Scanning of the nozzle 30 in the X and Y directions during the jiggle blast motion can occur at any selected feedrate (speed). An illustrative feedrate in the X and Y directions is 50 inches per minute under CNC control.

As mentioned, each nozzle 30 at each root end 12*a* is moved from opening 13*a*, then to opening 13*b*, then to opening 13*c* where the nozzles dwell and then undergo jiggle motion as described above. Movement between the openings 13*a* to 13*b* and 13*b* to 13*c* occurs at a rapid feedrate (speed) compared to the speed during lateral scanning constituting jiggle motion. For example, the rapid feedrate between openings 13*a*/13*b* and 13*b*/13*c* can be 200 inches per minute compared to the feedrate of 50 inches per minute during the jiggle motion.

Figure 4:
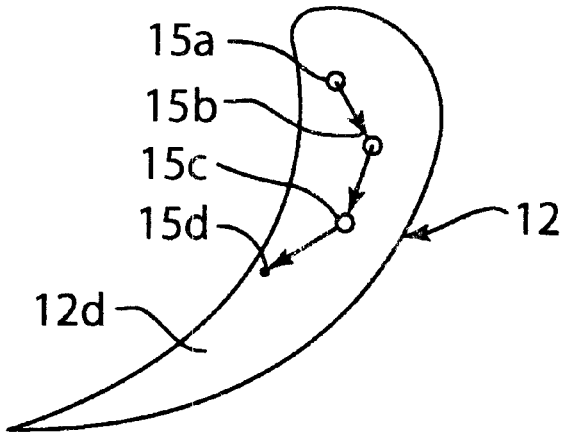
FIG. 4 is a plan view of the tip end of the airfoil casting showing the pattern of movement of a fluid spray nozzle relative to the tip openings.

After the openings 13*a*, 13*b*, 13*c* of root ends 12*a* of the castings 12 are water blasted on fixture 10, the castings 12 are removed from the fixture .10 and inverted and placed on another similar fixture (not shown) to hold the casting 12 in an inverted position with the tip end openings 15*a* through 15*d* facing upwardly as shown in FIG. 4. The blade tip openings 15*a* through 15*d* are shown as circular cross-section openings and have illustrative different diameters, such as 0.015 inch diameter for smaller openings and 0.035 inch for larger openings of an aerospace airfoil casting and as high as 0.150 inch for openings of an industrial gas turbine engine airfoil castings.

After the castings 12 are fixtured, the pumps are turned on, valve V is opened, and water at a pressure typically between 800–1500 psi is discharged from the nozzles 30 successively into the openings 15*a*–15*d* in the tip end 12*d* as now described.

Figure 5A:
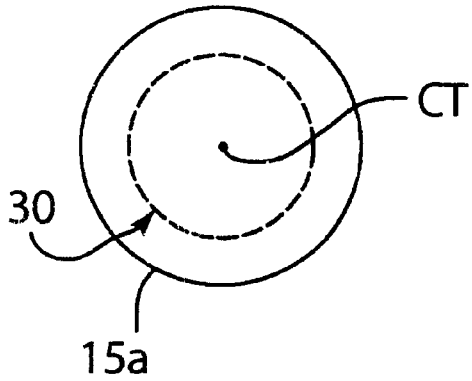
FIGS. 5A, 5B are schematic diagrams illustrating the dwell and then orbiting motion, respectively, at each tip opening.

Referring to FIGS. 4 and 5, the pattern of CNC controlled motion of each nozzle 30 pursuant to another embodiment of the invention is shown relative to a respective tip end 12*d*. In particular, each nozzle 30 traverses (as indicated by the arrow heads) at a relatively high feedrate (e.g. 200 inches per minute) successively from opening 15*a* to opening 15*b* to opening 15*c* to opening 15*d* at each tip end 12*d* under CNC control. At each tip opening, the nozzle 30 initially dwells with the nozzle center at a center CT of the tip opening determined by the CNC unit 60 for 5 seconds or other predetermined time, FIG. 5A.

Figure 5B:
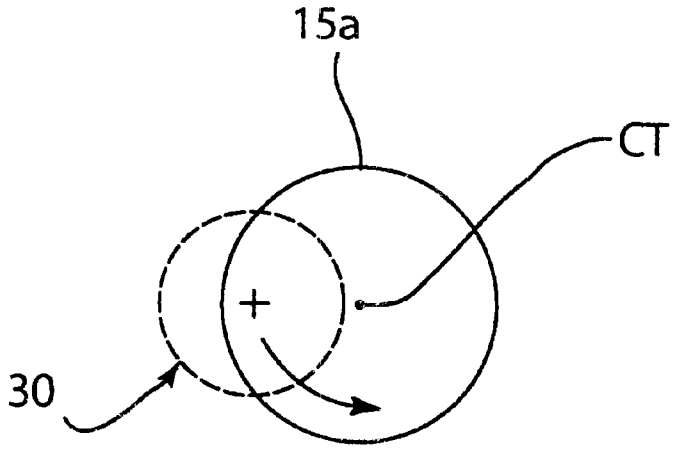

Then, at each opening 15*a*, 15*b*, 15*c*, 15*d*, the nozzle 30 is moved under CNC control in a so-called roto blast motion where the nozzle 30 is rotated at relatively low orbital speed (50 inches per minute) to orbit in a counterclockwise (or clockwise) direction about the center CT of each tip opening as indicated in FIG. 5B. The orbiting motion is imparted by concurrently moving the Y and X slides 44, 45 to this end.

As also illustrated in the Table II below, the radius of the orbital scan of the nozzles 30 relative to respective opening 15*a*, 15*b*, 15*c*, 15*d* and the number of orbits can be controlled by the CNC unit 60 and selected from one of the listings below stored in the CNC unit:

TABLE II

| Radius of orbits | Number of orbits |
|---|---|
| .005 inch | 2 |
| .010 | 5 |
| .015 | 10 |
| .020 | 15 |
| .025 | 20 |

For example, a first orbital scan of each nozzle 30 can occur at an orbital radius of 0.005 inch for two orbits. A different orbital scan can occur at 0.010 inch orbital radius for 5 orbits. A still different orbital scan can occur at 0.015 inch orbital radius for 10 orbits. Another orbital scan can occur at 0.020 inch orbital radius for 15 orbits. A further orbital scan can occur at 0.025 inch orbital radius for 20 orbits. One or more of these nozzle scans can be carried out at each opening 15*a*, 15*b*, 15*c*, 15*d*. Scanning of the nozzle 30 in the orbital manner can occur at any selected feedrate (speed). An illustrative feedrate of orbital scan is 50 inches per minute under CNC control.

The pressurized water flows through the passages 17 and exits the castings 12 at the root openings 13*a*, 13*b*, 13*c*, other tip end openings, and other openings that may be present on the castings.

Such scanning of root openings 13*a*, 13*b*, 13*c* and tip openings 15*a*, 15*b*, 15*c*, 15*d*, and trailing edge openings, if present, in the manner described above pursuant to the invention improves removal of residual ceramic core material from the passages 17 and allows the number of prior caustic core removal treatments or cycles to be reduced and yet still achieve acceptable core removal.

While the invention has been described hereabove in terms of specific embodiments thereof, it is not intended to be limited thereto and modifications and changes can made therein without departing from the spirit and scope of the invention as set forth in following claims.

We claim:

1. A method of removing ceramic core material from an internal passage of an airfoil casting, comprising discharging pressurized fluid comprising water from a spray nozzle at an opening of the passage at an exterior surface of the casting while scanning under computer numerical control a two dimensional area of the opening by orbiting movement of said spray nozzle about a center of said opening.

2. The method of claim 1 wherein a radius of the orbital motion can be varied.

3. The method of claim 1 wherein an opening at a tip of said airfoil is scanned.

4. A method of removing ceramic core material from an internal passage of a superalloy airfoil casting, comprising discharging pressurized fluid comprising water from a spray nozzle at an opening of the passage at an exterior root surface of the casting while scanning in orthogonal directions a two dimensional area of the root opening with said spray nozzle under computer numerical control, and discharging pressurized fluid comprising water from a spray nozzle at an opening of the passage at an exterior tip surface of the casting while orbitally scanning a two dimensional area of the tip opening with said spray nozzle under computer numerical control.

* * * * *

UNITED STATES PATENT AND TRADEMARK OFFICE

CERTIFICATE OF CORRECTION

PATENT NO. : 6,474,348 B1
DATED : November 5, 2002
INVENTOR(S) : James L. Beggs et al.

It is certified that error appears in the above-identified patent and that said Letters Patent is hereby corrected as shown below:

Column 7,
Line 2, replace “can be” with -- is --.

Signed and Sealed this

Fourth Day of March, 2003

JAMES E. ROGAN
*Director of the United States Patent and Trademark Office*